US007735295B2

(12) United States Patent
Surowiecki

(10) Patent No.: US 7,735,295 B2
(45) Date of Patent: Jun. 15, 2010

(54) SLOTTED TRACK WITH DOUBLE-PLY SIDEWALLS

(76) Inventor: Matt F. Surowiecki, 10023 Martin Luther Jr. Way S., Seattle, WA (US) 98178

( * ) Notice: Subject to any disclaimer, the term of this patent is extended or adjusted under 35 U.S.C. 154(b) by 0 days.

(21) Appl. No.: 11/706,588

(22) Filed: Feb. 15, 2007

(65) Prior Publication Data

US 2008/0196337 A1 Aug. 21, 2008

(51) Int. Cl.
*E04F 19/06* (2006.01)

(52) U.S. Cl. ..... 52/831; 52/241

(58) Field of Classification Search ..... 52/241, 52/242, 243, 656.1, 720.1, 733.2, 831
See application file for complete search history.

(56) References Cited

U.S. PATENT DOCUMENTS 3,101,817 A * 8/1963 Radek ..... 52/241
3,286,420 A * 11/1966 Lewis ..... 52/241
3,729,883 A * 5/1973 Thompson ..... 52/481.2
3,805,471 A * 4/1974 De Schutter ..... 52/714
3,877,193 A * 4/1975 Hall ..... 52/665
4,443,991 A * 4/1984 Mieyal ..... 52/586.2
4,881,355 A * 11/1989 Bosl et al. ..... 52/506.07
4,901,485 A * 2/1990 Menchetti et al. ..... 52/145
5,040,345 A * 8/1991 Gilmour ..... 52/243.1
5,127,760 A * 7/1992 Brady ..... 403/230
5,471,805 A * 12/1995 Becker ..... 52/241
5,755,066 A * 5/1998 Becker ..... 52/241
5,950,385 A * 9/1999 Herren ..... 52/481.1
6,871,470 B1 * 3/2005 Stover ..... 52/648.1
7,451,573 B2 * 11/2008 Orszulak et al. ..... 52/167.1
2005/0126104 A1 * 6/2005 Erickson et al. ..... 52/633
2005/0183361 A1 * 8/2005 Frezza ..... 52/293.3
2009/0064631 A1 * 3/2009 Frezza ..... 52/745.09

* cited by examiner

*Primary Examiner*—Gay Ann Spahn
(74) *Attorney, Agent, or Firm*—Bruce A. Kaser

(57) ABSTRACT

A slotted upper track (10) has double-thick sidewalls (34, 36 and 40, 42) through which the slots (54, 50 and 52, 56) extend. The sidewalls (34, 36 and 40, 42) and an interconnecting web (38) form a central channel in which upper end portions of the studs (12) are received. The upper track or header (10) includes secondary channels outwardly of the central channel that are formed by the flanges of the central channel (34, 36 and 40, 42) and auxiliary flanges (30, 46) and auxiliary webs (32, 44). The header or upper track (10) is of a one-piece construction, making it relatively economically to construct. Upper end portions of wallboard panels (WP) are positioned outwardly of the sidewalls (34, 36 and 40, 42) of the central channel. Trim panels (TP) of wallboard are connected to the auxiliary flanges (30, 46) and are positioned laterally outwardly of the upper end portions of the main wallboard panels (WP). The trim panels (TP) will move with the header or upper track (10) and the main wallboard panels (WP) will move with the studs (12).

1 Claim, 3 Drawing Sheets

SLOTTED TRACK WITH DOUBLE-PLY SIDEWALLS

TECHNICAL FIELD

This invention relates to framing walls composed of horizontal tracks and vertical studs. More particularly, it relates to an upper track construction that both permits vertical deflection and enables the wall to withstand larger wind loads or other side loads.

BACKGROUND OF THE INVENTION

It is known to provide a framing wall construction which permits relative movement between the lower track and stud assembly and the upper track so that vertical movement of the upper track relative to the studs and the lower track can occur during earthquakes, settlement, and other conditions which want to cause vertical movement between components of the framing wall.

U.S. Pat. No. 5,127,760, granted Jul. 7, 1992, to Todd A. Brady, shows a framing wall that includes vertically slotted tracks that are connected to the upper ends of studs by screws which extend through the slots and screw into upper end portions of the studs. A vertical space is provided between the upper ends of the studs and the web of the upper track. The upper track is free to move vertically relative to the studs while remaining connected to the studs by the screws.

U.S. Pat. No. 5,471,805, granted Dec. 5, 1995, to Dwayne W. Becker, shows a construction which allows vertical movement of the upper track relative to the studs without there being any screw connection of the studs to the upper track. Upper end portions of the studs extend into the upper track and merely slide up and down within a space defined by the track sidewalls.

Neither the construction disclosed by U.S. Pat. No. 5,127,760 nor the construction disclosed by U.S. Pat. No. 5,471,805 will permit the wall to withstand substantial side loads, such as gusting wind loads. There is a need for a framing wall construction that utilizes some of the features disclosed by U.S. Pat. Nos. 5,127,760 and 5,471,805 while at the same time providing the wall with the ability to withstand substantial side loads. It is the principal object of the present invention to fill this need.

BRIEF SUMMARY OF THE INVENTION

The building construction assembly of the present invention includes a horizontal header and vertical studs wherein the header is capable of vertical movement relative to the studs. The assembly of the invention includes an upper track or header that has a web and flanges connecting to the web. The flanges each comprise an inside part and an outside part that are connected together at lower edges. At least one of the flanges has at least one vertical slot in both the inside part and the outside part. The assembly includes a stud having a width less than the distance between the inside parts of the flanges. The stud is positioned between the inside parts of the two flanges. A screw extends through the slots in the inside and outside parts of the flange. The screw has a head that contacts the outside flange on opposite sides of the slot. The screw connects to the flanges of the header to the stud and permits the header to move vertically with respect to the stud.

Preferably, vertical slots are formed in both of the flanges. Each vertical slot extends through both the inner and outer part of the flanges. The screw fastener extends through each slot and into the stud. The screw fastener has a head that is contiguous the sheet metal on opposite sides of the slot.

Preferably, the flanges of the header and a web that interconnects the flanges of the header form a central channel and the header includes a side channel on at least one side of the central channel. The side channel has a web that is connected to the top of the outside part of the flange on its side of the header. This outside flange extends downwardly from the header in a spaced relationship from the outer part of the sidewall of the central channel, so as to form the secondary channel outwardly of the central channel. According to the invention, the secondary channel has a width substantially equal to a wallboard member that is attached to the studs.

This construction permits vertical movement of the upper track or header relative to the remaining portion of the wall, and at the same time adapts the wall to withstand substantial wind loads or other side loads.

Other objects, advantages and features of the invention will become apparent from the description set forth below, from the structure illustrated in the drawing, and from the principles that are embedded in the specific structures that are illustrated and described.

BRIEF DESCRIPTION OF THE SEVERAL VIEWS OF THE DRAWINGS

Like reference numerals and letters referred to like parts throughout the several views of the drawing, and.

DETAILED DESCRIPTION OF THE ILLUSTRATED EMBODIMENT

The various concepts are principles which make up the invention can be best understood by considering the following description of an example embodiment of the invention.

Figure 1:
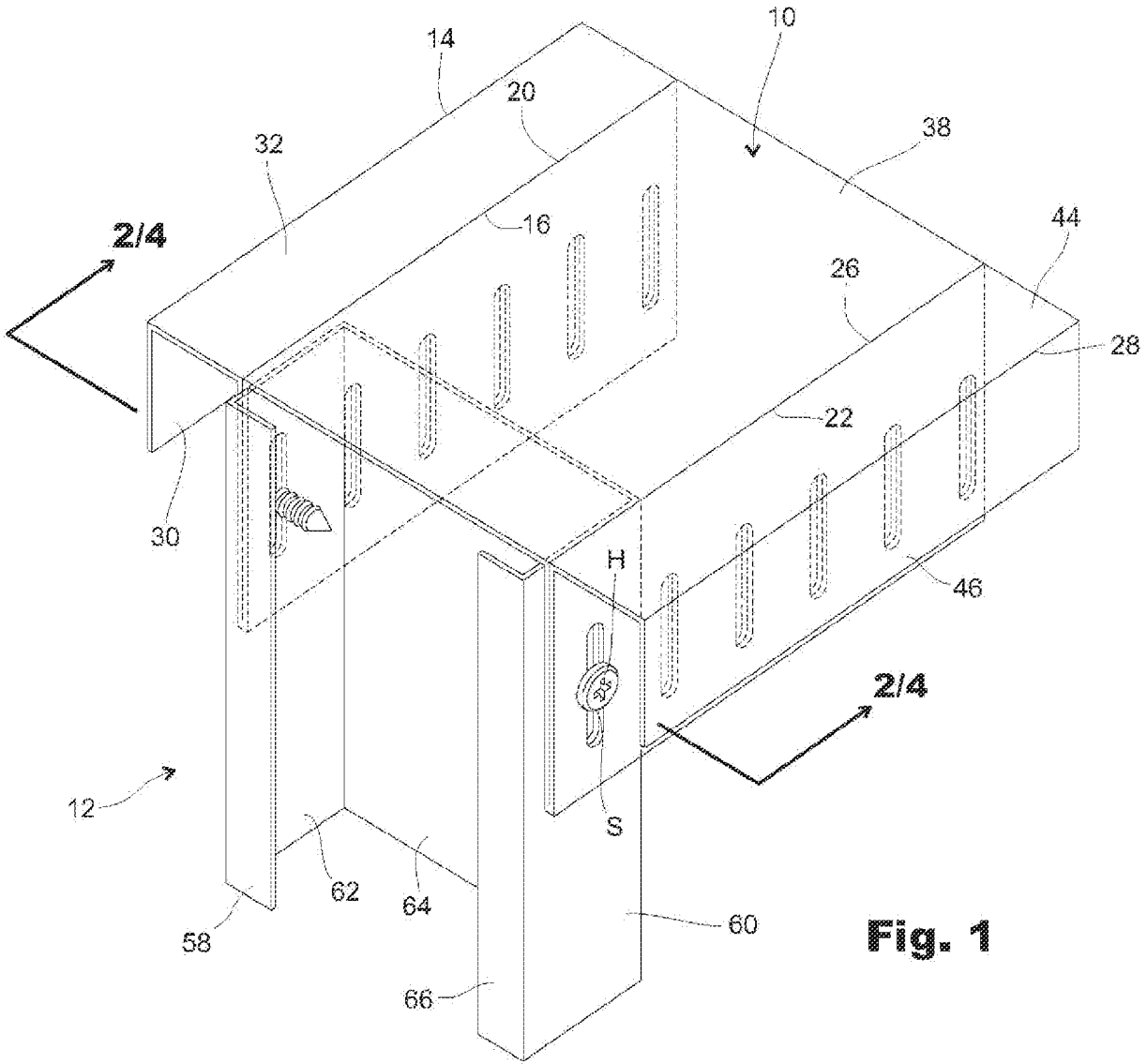
FIG. 1 is a fragmentary pictorial view of the upper end of a vertical stud within a horizontal upper track which embodies the invention, said view being taken from above and look down towards the top, one end and one side of the track.
Figure 2:
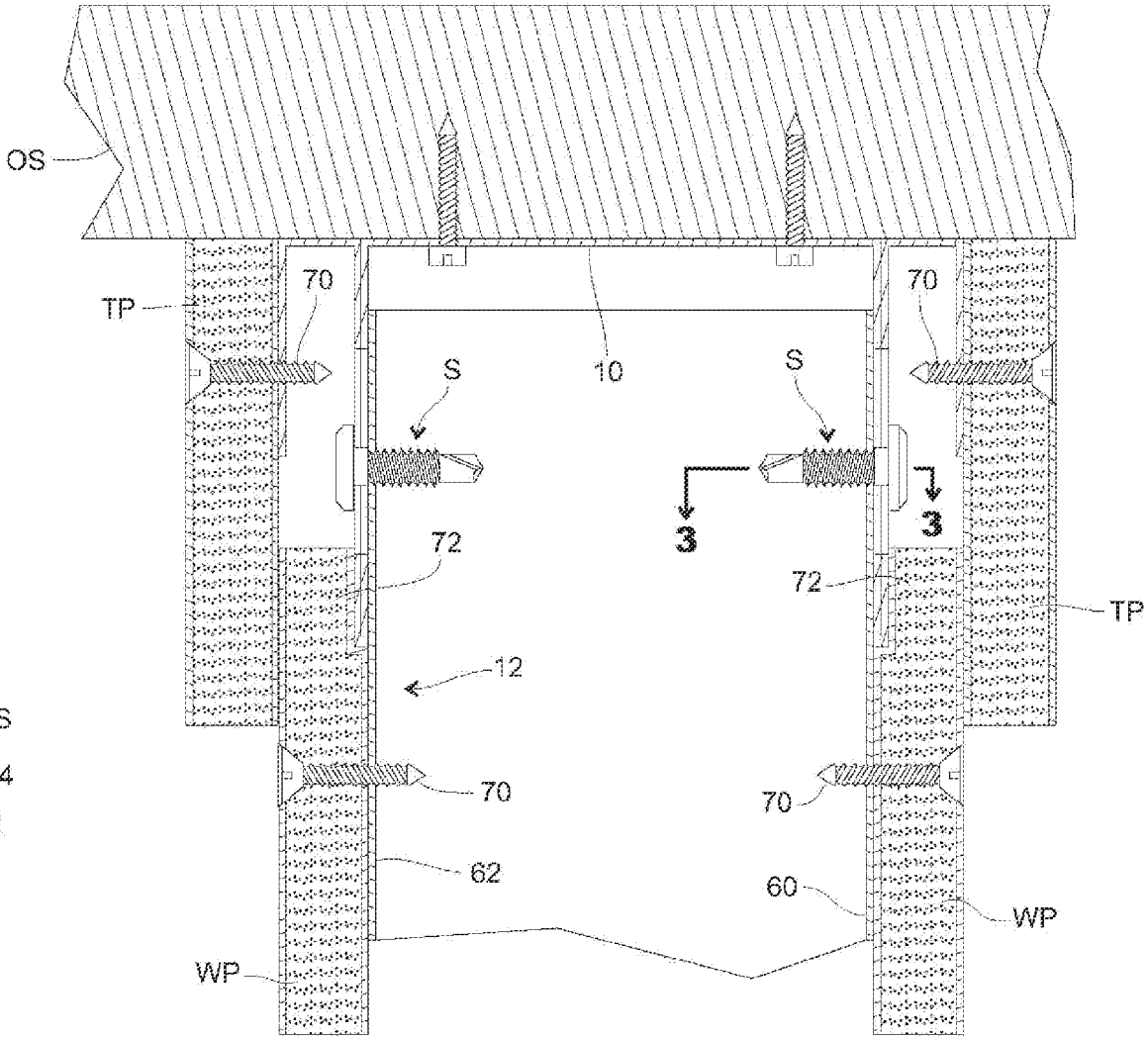
FIG. 2 is a fragmentary sectional view of the assembly of FIG. 1 installed, such view including fragmentary portions of wallboard members which are connected to the studs and additional wallboard members which are connected to the track, and such view showing screws extending through the sidewalls of the track and screwing into upper portions of the flanges of the stud, such view being taken substantially along line 2/4-2/4 of FIG. 1.
Figure 4:
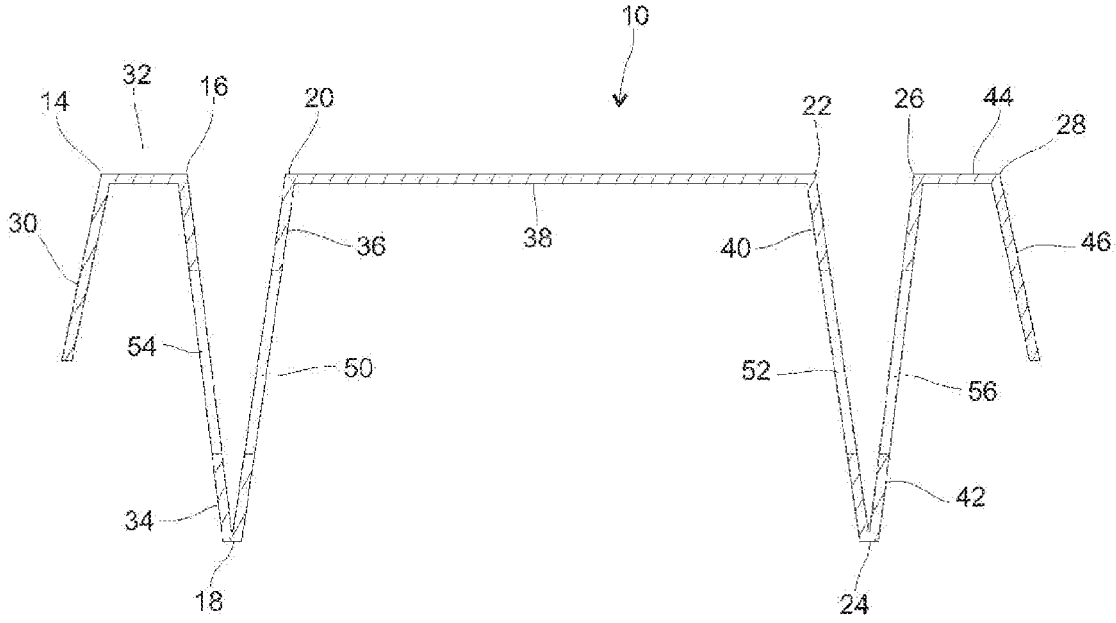
FIG. 4 is a sectional view of the upper track, also taken substantially along line 2/4-2/4 of FIG. 1, but omitting the wallboard pieces, the stud and the screws, and showing the pieces of the flange pulled apart for better illustrating the one-piece construction of the track.

Referring to FIGS. 1, 2 and 4, the upper track is designated 10 and the stud is designated 12. As best shown by FIG. 4, the track 10 is constructed from a single sheet of sheet metal that is bent along eight fold lines 14, 16, 18, 20, 22, 24, 26, 28. These fold lines divide the track 10 into nine panels or sections 30, 32, 34, 36, 38, 40, 42, 44, 48. Panels 34, 36 and 40, 42 are all substantially equal in width. Panels 30, 48 are narrower than the panels 34, 36, 40, 42. In the finished product, panel 30 is perpendicular to panel 32. Panel 32 is perpendicular to panel 34. Panel 34 is parallel to panel 36. Panel 38 is perpendicular to both panel 36 and panel 40. Panel 40 is parallel to and adjacent panel 42. Panel 42 is perpendicular to panel 44. Panel 44 is perpendicular to panel 48. Right angle corners are formed at each of the folds 14, 16, 20, 22, 26, 28. Panels 34, 36 are moved together and panels 40, 42 are moved together. Panels 34, 36 and 40, 42 are perpendicular to panel 38. Panels 34, 36 and 40, 42 form the sidewalls of a channel. The panel 38 forms a web for the channel. Together, panels 34, 36, 38, 40, 42 form a channel having a channel space below the web 38 and inwardly of the sides 34, 36 and 40, 42 of the channel. As shown by FIG. 2, web 10 is connected to an overhead structure OS, e.g. a roof or upper floor.

Panels 30, 48 are parallel to each other and to the walls 34, 36 and 40, 42.

The structure formed by the panels 36, 38, 40 is like the track disclosed by the aforementioned U.S. Pat. No. 5,127,760. The addition of panels 34, 42 connected at their bottoms to the bottoms of the panels 36, 40 give the track a sidewall thickness that is double the sidewall thickness of the track disclosed by U.S. Pat. No. 5,127,760. In the track disclosed by the patent, the two sidewalls of the track are provided with a plurality of longitudinally spaced apart slots that extend perpendicular to the track. In the track 10, similar slots are placed in all four of the panels 34, 36, 40, 42. When panels 34, 36 are together and panels 40, 42 are together, the slots 50, 52 are in substantial alignment with the slots 54, 56. In effect, slots 54, 50 form a single slot in a double-thick sidewall and slots 52, 54 form a slot in a double-thick second sidewall for the track 10.

In similar fashion to the stud and track assembly disclosed by U.S. Pat. No. 5,127,760, screw fasteners S extend through the slots 54, 50 and 56, 52 and screw into the flanges 60, 62 of the stud 12. In addition to flanges 60, 62, the stud 12 has a web 64 and lips 66, 68. The flanges 60, 62 extend perpendicular from the web 64 on the same side of the stud 12. Lips 66, 68 extend laterally inwardly from their points of connection with the flanges 60, 62, in co-planar parallelism with each other. Lips 66, 68 are also parallel to the web 64 and are perpendicular to the flanges 60, 62.

The screws S have heads H that are wider than the slots 50, 54 and 52, 56. As a result, the heads H bear against the sheet metal that closely borders the sides of the slots 50, 54, 52, 56. Screws S have threaded shanks 60 (FIG. 3) which form openings 62 in the stud flanges 60, 62. Preferably also, each head H includes a cylindrical spacer 64 between the head H and the threaded section 60. Cylindrical portion 64 is narrower than the slots 50, 54 and 52, 56. Portions 64 includes end surfaces 66 which contact the stud flanges 60, 62 in the manner shown by FIG. 3. Sections 64 are preferably slightly longer than the combined thickness of the panels 34, 36 and 40, 42. As a result, when the end surface 66 is against the stud flange 60, 62, there is a slight axial space 68 between the header of the screw H and the confronting side of the stud flange 60, 62. As a result, the screws S can be tightened and the sections 64 will act as spacers to keep the screwhead SH from clamping against the panels 34, 42. As a result, the screws S can be tightened and still will be able to freely move up and down in the slots 50, 54 and 52, 56. This feature is disclosed and claimed in my co-pending application Ser. No. 11/108,311, filed Apr. 18, 2005, and entitled Wall Construction.

Figure 3:
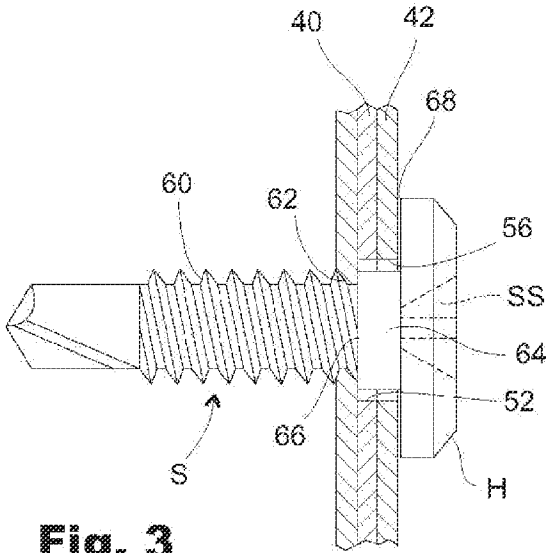
FIG. 3 is an enlarge scale fragmentary sectional view taken substantially along line 3-3 of FIG. 2.

As illustrated in U.S. Pat. No. 5,127,760, a framing wall is composed of a plurality of vertical studs and upper and lower horizontal track. The upper and lower ends of the studs fit within the channel spaces of the tracks with the flanges of the studs being closely adjacent the sidewalls of the tracks. Each track is separately installed in a vertical position between the upper and lower tracks. At the lower end, the tracks do not include slots. Screws are inserted through the sidewalls of the tracks and screwed into the flanges of the studs. At the upper end, the screws S are inserted through slots that are outwardly adjacent the flanges of the studs. As the screws S are self-tapping and when turned they form openings in the flanges and then the threaded portions 60 move into the openings and engage the sheet metal surrounding the openings, as shown by FIG. 3.

The sidewalls of the upper track 10 are twice as thick as the sidewalls of the upper track disclosed by U.S. Pat. No. 5,127,760. This makes the wall stronger and capable of withstanding larger side loads, e.g. wind loads, than the wall disclosed in U.S. Pat. No. 5,127,760.

When the studs 12 are connected to the upper and lower tracks, wallboard panels WP are connected to the studs 12, by screws 70 that extend through the wallboard panels WP and screw into the studs flanges 60, 62. The upper edge portions 72 of the wallboard panels WP have outer sides which are substantially flush with the outer surfaces of the panels 30, 48. After the panels WP are installed to the studs 12, narrow strips of wallboard WP are secured to the panels 38, 48 by the use or screws 70. Thus, panels WP are secured to the studs 12. Trim panels TP are secured to the upper side portions of the track 10. The track slots 50, 54 and 52, 56 permit vertical deflection or movement between the upper track 10 and the upper ends of the studs. Trim panels TP can move with the upper track 10. As they move, the upper track 10 and the trim panels TP move relative to the studs 12 and the panels WP.

A particularly important feature of the present invention is the one-piece construction of the track 10. Another important feature is the double thickness of the sidewalls of the upper track 10, formed by the panels 34, 36 and 40, 42. The use of the screws S that are illustrated completes an advantageous combination that is superior to the prior art assemblies that include only some of these features. In FIG. 3, the head H of screw S is shown having a screwdriver tip receiving socket SS.

The track 10 can be constructed by providing a long strip of sheet metal that is as wide as the combined widths of the panels 30, 32, 34, 36, 38, 40, 42, 44, 46. This strip is then conveniently bent along the hinge lines 14, 16, 18, 20, 22, 24, 26, 28 to form the upper track shape that is illustrated. The tracks are made into convenient lengths, e.g. 8 ft., 10 ft., 12 ft., etc. These sections and/or cut portions of the sections may be used to form the upper tracks for the framing walls of a building.

The illustrated embodiments are only examples of the present inventions and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein.

What is claimed is:

1. A slotted sheet metal header, comprising:

a downwardly opening central channel having a central channel top web and flat first and second sidewalls extending downwardly from the central channel top web, said central channel having a width of a size to snuggly receive the width dimension of a stud;

said first and second sidewalls each having a lower edge;

a first side channel on a first side of the central channel, said first side channel having a first side channel top web, a flat first inside wall extending downwardly from the first side channel top web along side the first sidewall of the central channel, and an outside wall extending downwardly from the first side channel top web, said first inside wall having a lower edge that is connected to the lower edge of the first sidewall;

a second side channel on a second side of the central channel, said second side channel having a second side channel top web, a second inside wall extending downwardly from the second side channel top web along side the second sidewall of the central channel, and an outside wall extending downwardly from the second side channel top web, said second inside wall having a lower edge that is connected to the lower edge of the second sidewall;

a first vertical slot extending through the first inside wall of the first side channel and a second vertical slot extending through the first sidewall of the central channel, said first and second vertical slots being aligned;

a third vertical slot extending through the second inside wall of the second side channel and a fourth vertical slot extending through the second sidewall of the central channel, said third and fourth vertical slots being aligned;

said outside walls of the first and second side channels having lower edges that are spaced above the lower edges of the sidewalls of the central channel and above at least a portion of each of the first, second, third, and fourth vertical slots, whereby access to the first, second, third, and fourth vertical slots is provided from below the lower edges of the outside walls of the first and second side channels;

said central channel including a channel space between the first and second sidewalls of the central channel that are sized to receive an end portion of a stud having a web and two flanges;

whereby an end portion of a stud may be placed within the channel space of the central channel and screw fasteners may be inserted through the first, second, third, and fourth vertical slots and screwed into the stud, for connecting the header to the stud;

wherein the central channel and the first and second side channels are constructed from a single sheet of metal that is bent to form corners where the first side channel top web meets the inside and outside walls of the first side channel, where the lower edge of the first inside wall of the first side channel meets the lower edge of the first sidewall of the central channel, where the top of the first sidewall of the central channel meets the central channel top web, where the central channel top web meets the second sidewall of the central channel, where the lower edge of the second sidewall of the central channel meets the lower edge of the second inside wall of the second side channel, where the second inside wall of the second side channel meets the second side channel top web, and where the second side channel top web meets the outside wall of the second side channel;

wherein the first sidewall of the central channel and the first inside wall of the first side channel are substantially in contact with each other; and wherein the second sidewall of the central channel and the second inside wall of the second side channel are substantially in contact with each other.

* * * * *